US006522217B1

(12) United States Patent
Shen

(10) Patent No.: US 6,522,217 B1
(45) Date of Patent: Feb. 18, 2003

(54) TUNABLE HIGH TEMPERATURE SUPERCONDUCTING FILTER

(75) Inventor: Zhi-Yuan Shen, Wilmington, DE (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/727,009

(22) Filed: Nov. 30, 2000

Related U.S. Application Data

(60) Provisional application No. 60/168,337, filed on Dec. 1, 1999.

(51) Int. Cl.[7] ..... H01P 1/00

(52) U.S. Cl. ..... 333/99.5; 505/210

(58) Field of Search ..... 333/995, 202; 505/210, 700, 866

(56) References Cited

U.S. PATENT DOCUMENTS

| | | | | |
|---|---|---|---|---|
| 4,757,285 A | * | 7/1988 | Krause | 333/203 |
| 4,849,722 A | | 7/1989 | Cruchon et al. | |
| 4,962,083 A | | 10/1990 | Herman et al. | |
| 5,017,554 A | | 5/1991 | Subramanian | |
| 5,616,538 A | | 4/1997 | Hey-Shipton et al. | |
| 5,616,539 A | | 4/1997 | Hey Shipton et al. | |
| 5,908,811 A | | 6/1999 | Das | |
| 5,955,931 A | | 9/1999 | Kanebo et al. | |
| 5,968,876 A | | 10/1999 | Sochor | |
| 6,108,569 A | | 8/2000 | Shen | |

FOREIGN PATENT DOCUMENTS

| | | |
|---|---|---|
| EP | 0 281 753 | 3/1994 |
| EP | 0720248 | 7/1996 |
| JP | 63 028103 | 2/1988 |
| JP | 04368006 | 12/1992 |
| WO | WO 88 05029 | 7/1988 |

OTHER PUBLICATIONS

International Search Report (PCT/US00/32673) dated Nov. 4, 2001.

C.K. Ong, et al., High Temperature Superconducting Band-pass Spiral Filter, IEEE Microwave and Guided Wave Letters, vol. 9, No. 10, Oct. 1999 (Singapore).

B.A. Aminov, et al., High Q Tunable Ybco Disk Resonator Filters For Transmitter Combiners in Radio Base Stations, IEEE MTT–S Digest, pp. 363–366 (1998).

Oates, D. E. et al., Tunable YBCO Resonators on YIG Substrates, IEEE Trans. Appl. Supercond., 1997, pp. 2338–2342, vol. 7, No. 2.

Subramanyam, G. et al., A Novel K–Band Tunable Microstrip Bandpass Filter Using a Thin Film HTS/Ferroelectric/Dielectric Multilayer Configuration, NASA AgencyReport No. NASA./TM–1998–207940, 1998.

Crowe, T. et al., GaAs devices and circuits for terahertz applications, Infrared Physics & Technology, 1999, pp. 175–189, vol. 40.

* cited by examiner

*Primary Examiner*—Robert Pascal
*Assistant Examiner*—Joseph Chang

(57) ABSTRACT

Described are tunable high temperature superconducting band-pass and band-reject filters having broad tuning frequency range without performance deterioration, as well as high temperature superconducting filter circuits for use therein.

19 Claims, 6 Drawing Sheets

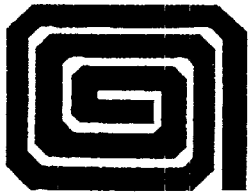
Fig. 3a
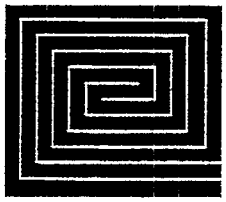
Fig. 3b
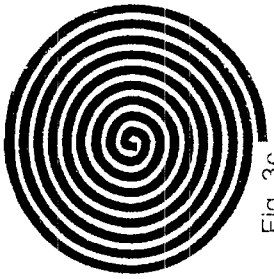
Fig. 3c
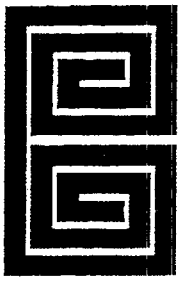
Fig. 3d
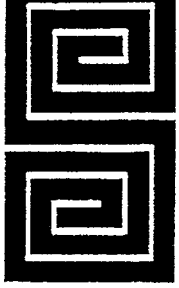
Fig. 3e
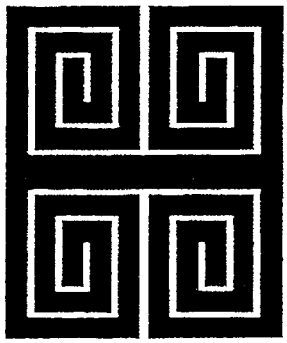
Fig. 3f
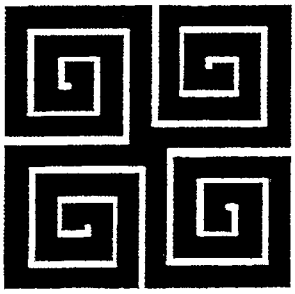
Fig. 3g
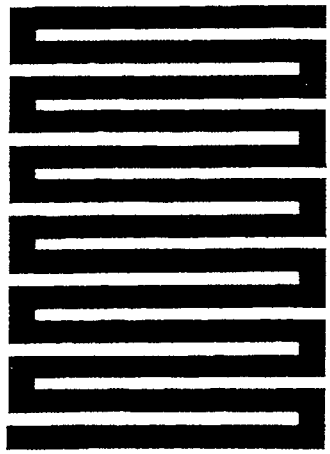
Fig. 3h
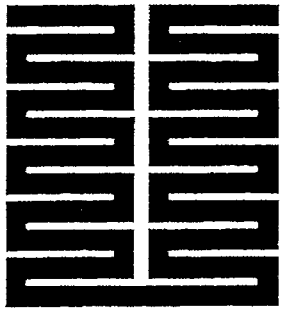
Fig. 3i
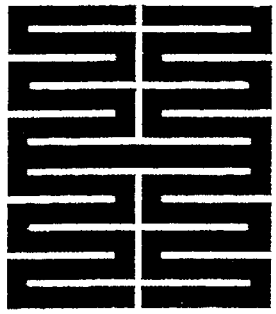
Fig. 3j
Fig. 3

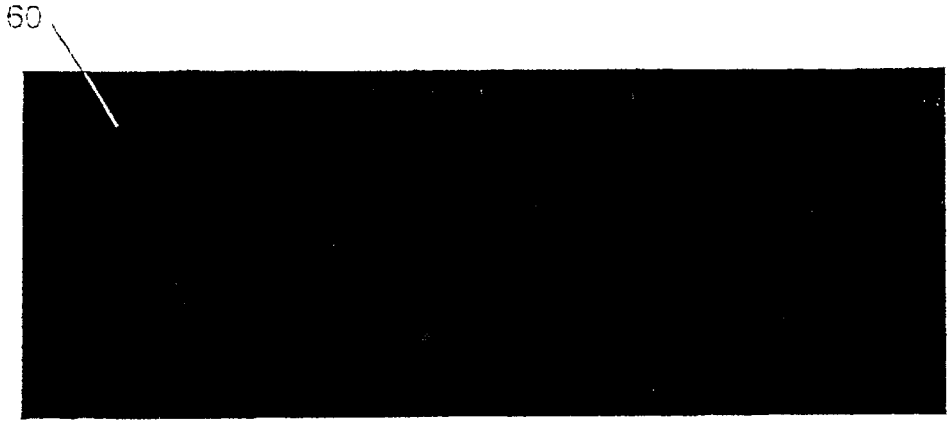
Fig. 5a
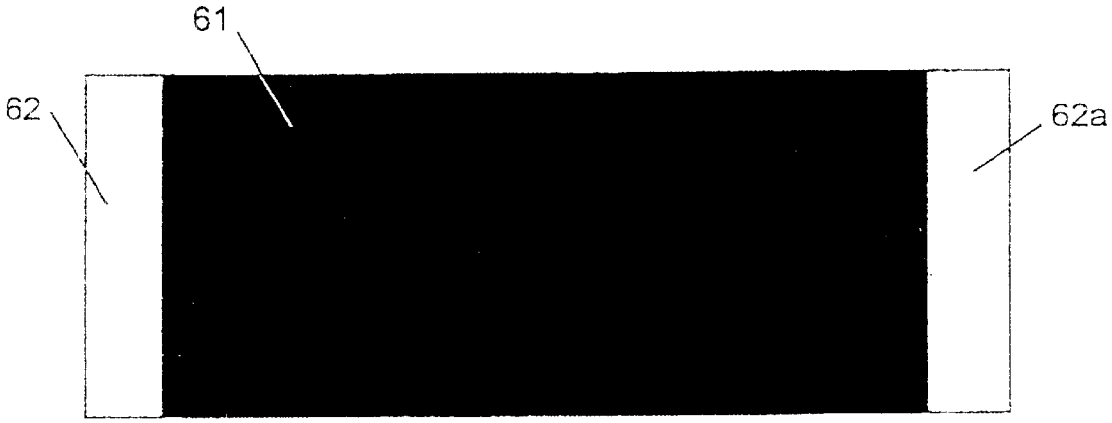
Fig. 5b
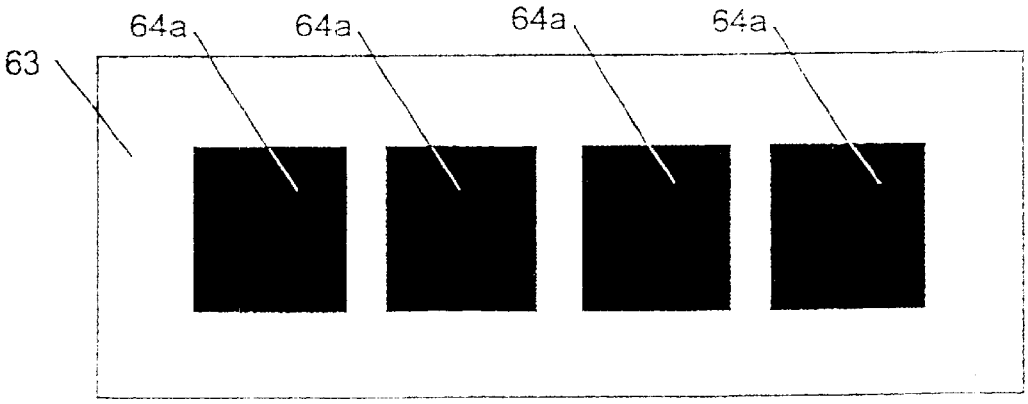
Fig. 5c
Fig. 5

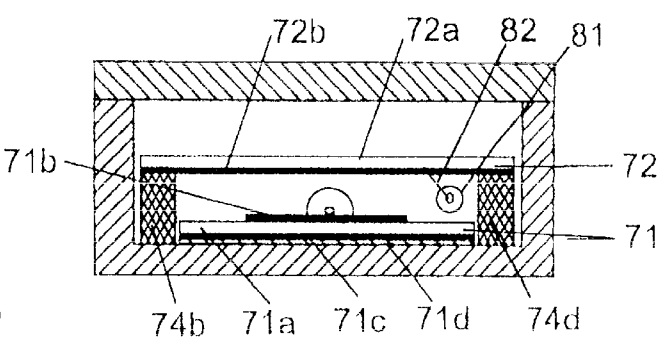
Fig. 6b
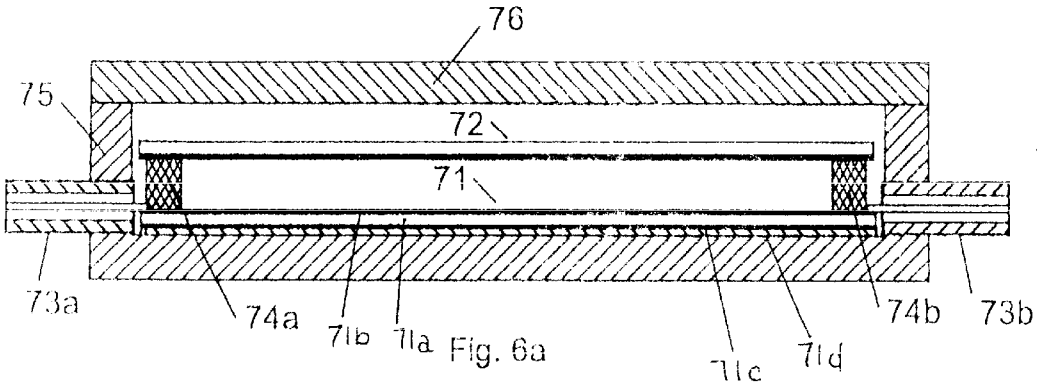
Fig. 6a
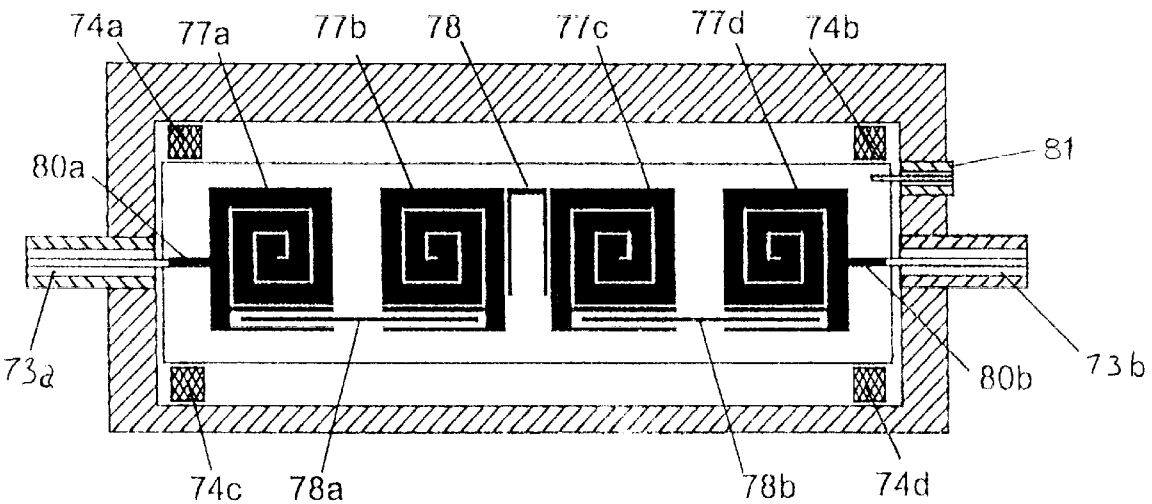
Fig. 6c
Fig. 6

TUNABLE HIGH TEMPERATURE SUPERCONDUCTING FILTER

CROSS-REFERENCE TO RELATED APPLICATION

This application claims priority under 35 U.S.C. §119 from U.S. Provisional Application Ser. No. 60/168,337 (filed Dec. 1, 1999), which is incorporated by reference herein for all purposes as if fully set forth.

FIELD OF THE INVENTION

This invention generally relates to tunable High-Temperature Superconducting (HTS) filters and, more particularly, to such filters wherein the center frequency can be tuned within a broad frequency range without performance deterioration.

BACKGROUND OF THE INVENTION

Until the late 1980s, the phenomenon of superconductivity found very little practical application due to the need to operate at temperatures in the range of liquid helium. In the late 1980s ceramic metal oxide compounds containing rare earth centers began to radically alter this situation. Prominent examples of such materials include YBCO (yttrium-barium-copper oxides, see WO88/05029 and EP-A-0281753), TBCCO (thallium-barium-calcium-copper oxides, see U.S. Pat. No. 4,962,083) and TPSCCO (thallium-lead-strontium-calcium-copper oxides, see U.S. Pat. No. 5,017,554). All of the above publications are incorporated by reference herein for all purposes as if fully set forth.

These compounds, referred to as HTS (high temperature superconductor) materials, were found to be superconductive at temperatures high enough to permit the use of liquid nitrogen as the coolant. Because liquid nitrogen at 77 K (−196° C./−321° F.) cools twenty times more effectively than liquid helium and is ten times less expensive, a wide variety of potential applications began to hold the promise of economic feasibility. For example, HTS materials have been used in applications ranging from diagnostic medical equipment to particle accelerators.

An essential component of many electronic devices, and particularly in the communications field, is the filter element. HTS filters are well known to have a wide variety of potential applications in telecommunication, instrumentation and military equipment. HTS band-pass filters have the advantage of extremely low in-band insertion loss, high off-band rejection and steep skirts. HTS band-reject filters have the advantage of extremely high in-band rejection, low off-band insertion loss, and steep skirts. The advantages of both types of filters are due to the extremely low loss in the HTS materials. Commonly owned U.S. Pat. No. 6,108,569 (incorporated by reference herein for all purposes as if fully set forth) describes HTS mini-filters which utilize self-resonant spiral resonators as the basic building block. These HTS mini-filters have very compact size and light weight, which greatly ease the cryogenic requirement and thus increase the ability to be used in many applications.

Certain applications require filters to have frequency tuning capability. There are three primary methods known in the art to achieve frequency tuning capability. The first method, described in D. E. Oates et al, *IEEE Trans. Appl. Supercond.* 7, 2338 (1997), involves the use of a ferrite material. The major problem with using ferrite materials is that the Q-value of ferrite materials at cryogenic temperatures is too low compared to HTS materials. In other words, introducing ferrite material into HTS filters deteriorates the performance.

The second method, described in G. Subramanyam et al, NASA Agency Report No. NASA/TM-1998-207490, involves the use of ferroelectric materials. Ferroelectric material tuning has the same problem of low Q-value as the ferrite material tuning and, in addition, has a bias circuit problem. In order to tune the filter, a bias circuit is needed to apply a voltage across the ferroelectric material, which may deteriorate the filter's performance.

The third method, described in T. W. Crowe et al, *Infrared Phys. And Tech.* 40, 175 (1999), involves the use of a varactor as a variable capacitance attached to the filter's resonator. The problems of this approach are similar to those of the ferroelectric tuning, i.e. low Q-value and bias circuit problems.

SUMMARY OF THE INVENTION

One object of this invention, consequently, is to provide a tunable HTS filter without performance degradation caused by Q-value deterioration related to the use of foreign materials and/or bias circuitry. Thus, in accordance with one aspect of the present invention, there is provided a tunable HTS filter comprising:

(a) an enclosure having a first inner surface, a second inner surface spaced apart from and opposite to said first inner surface, and at least one other inner surface connecting said first and second inner surfaces to form said enclosure, wherein at least said inner surfaces of said enclosure are constructed of a conductive material, and wherein said enclosure is fitted with an input connector and an output connector;

(b) an HTS filter circuit within said enclosure, said HTS filter circuit comprising a substrate having a front surface spaced apart from and opposite to said second inner surface, a back surface in grounding contact with said first inner surface, an HTS filter element on said front surface, said HTS filter element comprising one or more HTS resonators, an input transmission line coupling said HTS filter element to said input connector, and an output transmission line coupling said HTS filter element to said output connector;

(c) a plate within said enclosure, said plate having a front surface spaced a distance apart from and opposite to said HTS filter circuit, and a back surface opposite to said second inner surface, wherein said front surface is covered with an HTS film on at least the portion of said front surface opposite said one or more resonators of said HTS filter element;

(d) an actuator connected to said plate and to one or more of said first inner surface, said second inner surface and said HTS filter circuit, said actuator defining said distance at which said front surface of said plate is spaced apart from said front surface of said HTS filter element, provided that said actuator connection is non-conductive between said plate and said HTS filter circuit; and (e) a tuning controller connected to said actuator to adjust said distance between said front surface of said plate and said HTS filter element of said HTS filter circuit.

The aforementioned plate interacts with the magnetic field of the resonators in the HTS filter circuit, changing the resonant frequency thereof as the distance between the plate and the HTS filter circuit changes. The movement of plate thus "tunes" the center frequency of the HTS filter.

During the tuning process, however, the inter-resonator coupling may change as well, which in turn can cause the filter's bandwidth and the shape of the frequency response to change. These side effects may deteriorate the filter's performance, and another object of the present invention is to provide an HTS filter element that can compensate for these side effects. Thus, in accordance with another aspect of the present invention, there is provided an HTS filter circuit that includes one or more compensating inter-resonator coupling circuits to compensate for these potential side effects. More specifically, there is provided an HTS filter circuit comprising:

(1) a substrate having a front side and a back side;

(2) at least two HTS resonators in intimate contact with said front side of said substrate;

(3) an input coupling circuit comprising a transmission line with a first end coupled to a first one of said at least two self-resonant spiral resonators, and a second end for coupling to an input connector;

(4) an output coupling circuit comprising a transmission line with a first end coupled to a second of said at least two self-resonant spiral resonators, and a second end for coupling to an output connector;

(5) an inter-resonator coupling circuit comprising an HTS transmission line at least in part disposed between an adjacent pair of said at least two HTS resonators, said transmission line coupling said adjacent pair of HTS resonators;

(6) a blank HTS film disposed on said back side of said substrate; and (7) a film disposed on said blank HTS film as a grounding contact to an enclosure for said HTS filter circuit.

These and other objects, features and advantages of the present invention will be more readily understood by those of ordinary skill in the art from a reading of the following detailed description with reference to the accompanying drawings.

BRIEF DESCRIPTION OF THE DRAWINGS

FIG. 3 shows various preferred embodiments of HTS resonators suitable for use as building blocks of the tunable HTS filters in accordance with the present invention. FIG. 3*a* shows a rectangular-shaped spiral resonator with rounded corners. FIG. 3*b* shows a rectangular-shaped double spiral resonator. FIG. 3*c* shows a circular-shaped spiral resonator. FIG. 3*d* shows a mirror symmetrical rectangular-shaped dual spiral resonator. FIG. 3*e* shows a 180° rotational symmetrical rectangular-shaped dual resonator. FIG. 3*f* shows a double mirror symmetrical rectangular-shaped quadruple spiral resonator. FIG. 3*g* shows a 90° rotational symmetrical square-shaped quadruple spiral resonator. FIG. 3*h* shows a meander line resonator. FIG. 3*i* shows a mirror symmetrical dual meander line resonator. FIG. 3*j* shows a double mirror symmetrical quadruple meander line resonator.

FIG. 5 shows various preferred embodiments of a plate for tuning the center frequency of the tunable HTS filters in accordance with the present invention.

FIG. 6 shows various views of another embodiment of the structure to move the plate for tuning the present invention of a tunable HTS filters.

DETAILED DESCRIPTION OF THE PREFERRED EMBODIMENTS

Figures 1, 1A, 1B, 1C:
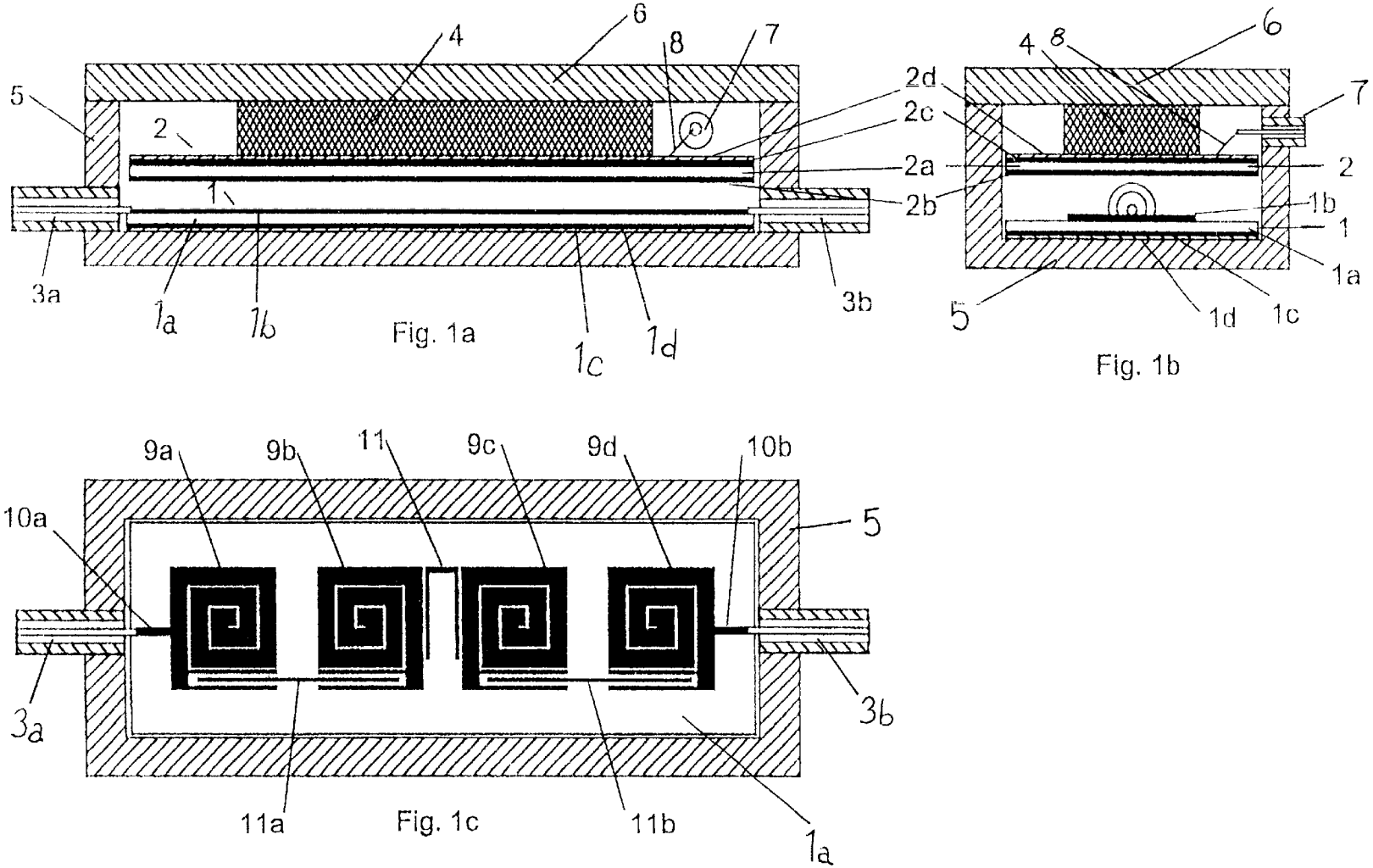
FIG. 1 shows various views of an illustrative embodiment of a tunable HTS band-pass filter in accordance with the present invention; specifically, a tunable HTS 4-pole band-pass mini-filter circuit with square shape spiral resonators.
FIG. 1*a* shows the longitudinal cross sectional view.
FIG. 1*b* shows the transverse cross sectional view.
FIG. 1*c* shows the top view, in which the top of the enclosure, the plate and the actuator have been removed.

As indicated above, the present invention provides a tunable HTS filter without performance degradation caused by Q-value deterioration related to the use of foreign materials and/or bias circuitry. This is accomplished by an HTS filter containing a moveable plate for tuning the center frequency of HTS filter without performance deterioration. Because of no foreign materials other than HTS filter itself, i. e. HTS film and its substrate, and no bias circuit introduced in the HTS filter's circuit, Q-value deterioration will not occur. Therefore, the tunable HTS filter in accordance with this invention can be tuned within a broad frequency range without significant performance deterioration.

A preferred embodiment of the invention is to provide the HTS filter with a tuning structure, comprising the aforementioned plate spaced a distance apart from the HTS filter circuit, and connected to an actuator which can change the position of the plate relative to the HTS filter circuit. This embodiment enables tuning of the center frequency of the HTS mini-filters without performance deterioration.

The enclosure for the tunable HTS filter is an outer package to contain the various circuit elements. Because the HTS filter element operates under cryogenic conditions, it is preferred that the enclosure be a vacuum dewar assembly having a cryogenic source connected thereto, and preferably integral therewith. The shape of the enclosure is not considered critical so long as the enclosure contains all of the requisite components. For example, the enclosure can be square, rectangular, circular or any other shape. In this context, the first inner surface refers, for example, to the interior surface of the top of the enclosure, the second inner surface refers, for example, to the interior surface of the bottom of the enclosure, and the at least one other inner surface refers, for example, to the interior surface of the side wall(s) of the enclosure. The number of other inner surfaces, of course, will depending on the shape of the enclosure. For example, a circular (tubular) enclosure will have a top, a bottom and only one other interior surface, while a square (cubic) enclosure will have a top, a bottom and four side wall interior surfaces.

The inner surfaces of the enclosures are constructed of a conductive material, for example, for grounding reasons. The enclosure can thus be constructed of a ceramic or plastic material in which the inner surfaces have been coated or plated with a conductive material such as a metal. For ease of construction, however, it is preferred that the enclosure is metal.

As indicated above, it is preferred that the enclosure be a vacuum dewar assembly having a cryogenic source connected thereto. Operating the cryoelectric components within a vacuum is highly desirable to reduce convective heat loading to the cryoelectronic components from molecules within the dewar assembly.

The cryogenic source provides cooling to the cryogenic electronic components. The cryogenic source can, if the device is deployed in outer space, be the ambient outer space conditions, but the cryogenic source is typically a miniature cryocooler unit of the appropriate size and power requirements. Such miniature cryocoolers are typically Stirling cycle machines such as those described in U.S. Pat. No. 4,397,155, EP-A-0028144, WO90/12961 and WO90/13710 (all of which are incorporated by reference herein as if fully set forth).

The total cooling power required by the cryoelectronics portion directly affects the size, weight and total operating power of a cooler functioning as the cryogenic source. The larger the total cooling power required, the larger the size, weight and total operating power of the cooler. The total cooling power required is a function of a number of factors including, most importantly, the infrared heating of the cold surfaces, conductive heat flow from gas molecules from warm surfaces to the cold surfaces, and the conductive heat leak due to the connectors. Infrared heating of the cold surfaces can be reduced by two parameters—the size of the cold surfaces and the temperature at which the cold surfaces are held relative to ambient. Filter size and packaging dominates the size of the cold surfaces.

For that reason, it is highly desirable to reduce the size of the cryoelectronic components to reduce package size. This can be done, as discussed in further detail below, by utilizing the HTS mini-filter configurations and spiral resonators disclosed in previously incorporated U.S. Pat. No. 6,108,569, which may be modified as discussed further below.

The enclosure is further fitted with input and output connectors, which transition from cryogenic conditions within the enclosure to ambient conditions outside the enclosure. The input and output connectors are preferably integral to the enclosure and hermetically sealed.

Additional preferred details regarding the enclosure, cryogenic source and connectors may be found by reference to U.S. Provisional Application No. 60/230,682 (filed Sep. 7, 2000), which is incorporated by reference herein for all purposes as if fully set forth.

As just indicated, the preferred configuration of the HTS filter circuit is as disclosed in previously incorporated U.S. Pat. No. 6,108,569. More specifically, the preferred HTS filter circuit comprises:

(1) a substrate having a front surface and a back surface;
(2) at least two HTS resonators in intimate contact with said front surface of said substrate;
(3) an input coupling circuit comprising a transmission line with a first end coupled to a first one of said at least two HTS resonators, and a second end for coupling to an input connector;
(4) an output coupling circuit comprising a transmission line with a first end coupled to a second of said at least two HTS resonators, and a second end for coupling to an output connector;
(5) an inter-resonator coupling;
(6) a blank HTS film disposed on said back side of said substrate; and
(7) a film disposed on said blank HTS film as a grounding contact to an enclosure for said HTS filter circuit.

The HTS resonators used in the practice of this invention can have a wide variety of shapes including a rectangular-shaped single spiral resonator with rounded corners, a circular-shaped single spiral resonator, a rectangular-shaped double spiral resonator, a circular-shaped double spiral resonator, a mirror symmetrical rectangular-shaped double spiral resonator with rounded corners, a 180° rotational rectangular-shaped double spiral resonator with rounded corners, a double mirror symmetrical rectangular-shaped spiral resonator with rounded corners, a 180° rotational symmetrical rectangular-shaped spiral resonator with rounded corners, a 90° rotational symmetrical square-shaped quadruple spiral resonator with rounded corners, a meander line resonator with rounded corners, a mirror symmetrical double meander line resonator with rounded corners, and a double mirror symmetrical quadruple meander line resonator with rounded corners, as described and shown in more detail below in reference to the Figures. Preferred self-resonant spiral resonators are those disclosed in previously incorporated U.S. Pat. No. 6,108,569, comprising a high temperature superconductor line oriented in a spiral fashion (i) such that adjacent lines are spaced from each other by a gap distance which is less than the line width; and (ii) so as to form a central opening within the spiral, the dimensions of which are approximately equal to the gap distance.

The HTS filter circuit is oriented within the enclosure such that the back surface is in grounding contact with the first inner surface of the enclosure. In a preferred embodiment, the first inner surface can also function as a cooling plate, with the "outside" surface (opposite the first inner surface) being in contact with the cryogenic source. More preferably, the enclosure and cryogenic source, such as a miniature cryocooler, form an integrated package, which can further reduce the ultimate size and weight of the tunable HTS filter unit.

Opposite the front surface (e.g., the resonators) of the HTS filter circuit is the plate, which interacts with the magnetic field of the resonators in the HTS filter circuit, changing the resonant frequency thereof as the relative distance between the plate and the HTS filter circuit changes. The movement of plate relative to the HTS filter circuit thus "tunes" the center frequency of the HTS filter.

The inter-resonator coupling of the HTS filter circuit may simply be a gap between adjacent resonators in which the electromagnetic fields of the two resonators overlap. During the tuning process, however, this type of inter-resonator coupling may change, which in turn can cause the filter's bandwidth and the shape of the frequency response to change. These side effects may deteriorate the filter's performance. Thus, in another aspect of the present invention, the HTS filter element preferably includes one or more compensating inter-resonator coupling circuits to compensate for these potential side effects.

A preferred coupling circuit comprises an HTS transmission line at least in part disposed between an adjacent pair of HTS resonators such that the transmission line couples such adjacent pair. The coupling can occur, for example, by directly attaching the HTS transmission line to a resonator, inserting the HTS transmission line into a slot between two split branch lines at the end of a resonator, placing the HTS transmission line close by and parallel to the edge of a resonator, or any combination of the above.

The moveable plate utilized in the tunable HTS filters of this invention comprises a substrate having a front surface and a back surface, the front surface facing the HTS filter circuit and the back surface facing the second inner surface of the enclosure. At least a portion of the front surface of the plate is with an HTS film, that minimal portion being the area on the front surface corresponding to the position of the resonators on the front surface of the HTS filter circuit. For ease of construction, the HTS film may, however, cover the entire front surface or any other portions thereof, for example, an area slightly larger than that corresponding to the resonators on the front surface of the HTS filter circuit, or the entire front surface except for the two end locations facing the input and output circuit areas of the HTS filter circuit. The back surface is preferably covered with a blank HTS film over which a blank conductive film has been deposited, particularly if a piezoeletric actuator is attached to this back surface.

In a preferred embodiment of the present invention, the superconducting materials of the HTS filters have a transition temperature, $T_c$, greater than about 77 K. In addition, the substrates for the HTS filter circuit and plate should have a dielectric material lattice matched to the HTS film deposited thereon, with a loss tangent less than about 0.0001.

Specific preferred materials for the HTS filter and plate include the following:

HTS materials—one or more of $YBa_2Cu_3O_7$, $Tl_2Ba_2CaCu_2O_8$, $TlBa_2Ca_2Cu_3O_9$, $(TlPb)Sr_2CaCu_2O_7$ and $(TlPb)\ Sr_2Ca_2Cu_3O_9$;

substrate materials—one or more of $LaAlO_3$, MgO, $LiNbO_3$, sapphire and quartz; and blank ground films—one or more of gold and silver.

The actuator can take any number of forms. A simple form is a screw mechanism attached to the back surface of the plate through the enclosure, which can be rotated manually and/or by mechanical (e.g., with a lever) and/or electromechanical devices (e.g., a motor). A preferred embodiment is to construct the actuator from a piezoelectric material, which allows the relative distance between the plate and HTS filter circuit to be controlled and adjusted by applying voltage to the actuator (or actuators).

In a preferred embodiment, the actuator of the HTS filter is one or more (depending on configuration discussed below) piezoelectric blocks made of a piezoelectric material operating at temperature below 80 K and having a sensitivity better than $5\times10^{-5}$/volts/cm. Preferred piezoeletric materials meeting these conditions include, for example, PZT (lead zirconate titanate, $(PbZr)TiO_3$) and barium titanate ($BaTiO_3$).

The actuator can be attached to the plate in a number of different configurations. For example, one end of a piezoelectric block (with a metallic surface) can be attached to the back surface of the plate, with the other end attached to the second internal surface of the metallic enclosure. As another example, one end of four substantially identical piezoelectric blocks (each with a metallic surface) can be attached to each corner of the front surface of the plate, with the other end of each non-conductively attached to the first internal surface of the enclosure or each corresponding corner of the HTS filter circuit.

To control the piezoelectric actuators, a metallic wire can be electrically connected to the metallic surface on a piezoelectric block (for example, either directly or via the conductive layer on the back surface of the plate) and the opposite end of the metallic wire connected to at least one tuning connector. The can in turn be connected to a control device to apply a pre-determined control voltage.

Various preferred embodiments of the present invention can best be understood in reference to the Figures.

FIG. 1 shows an embodiment of the present invention of a tunable HTS band-pass filter. In FIG. 1*a*, 1 is the HTS filter circuit, and 2 is the plate. In FIG. 1*b*, 1*a* is the substrate of the HTS filter circuit 1. An HTS circuit pattern 1*b* is deposited on front surface of substrate 1*a*. A blank HTS film 1*c* is deposited on the back surface of substrate 1*a* serving as the ground plane of the filter 1. A conductive film 1*d* (preferably a metal such as gold or silver) is deposited on the surface of blank HTS film 1*c*.

The HTS circuit pattern 1*b* comprises four HTS spiral resonators, 9*a*, 9*b*, 9*c*, 9*d*, input transmission line 10*a*, output transmission line 10*b*, and inter-resonator coupling transmission lines, 11, 11*a*, 11*b*, to form a 4-pole band-pass filter, as shown in FIG. 1*c*. The HTS filter circuit 1 is attached to the bottom (first inner surface) of enclosure 5. Input connector 3*a*, output connector 3*b*, and tuning connector 7 are inserted into the side wall of enclosure 5. As shown in FIG. 1*c*, the input connector 3*a* and output connector 3*b* are connected to the input and output transmission lines 10*a* and 10*b*, respectively.

As shown in FIG. 1*b*, plate 2 comprises a substrate 2*a* with HTS films 2*b* and 2*c* deposited on the front surface and back surface of substrate 2*a*, respectively. A conductive film 2*d* (preferably a metal such as gold or silver) is deposited on top of HTS film 2*c*.

As shown in FIG. 1*a*, an actuator 4 made of piezoelectric material has one side attached to the back surface of plate 2 (via conductive film 2*d*) and the opposite side attached to the inner surface of a lid 6 (the second inner surface) constituting part of enclosure 5. Actuator 4 is used to move plate 4 relative to HTS filter circuit 1 for tuning the center frequency of HTS filter circuit 1. A wire 8 with one end connected to a tuning connector 7 and the other end connected to actuator 4 via conductive film 2*d* is used to apply a tuning voltage to actuator 4.

Figures 2, 2A, 2B, 2C:
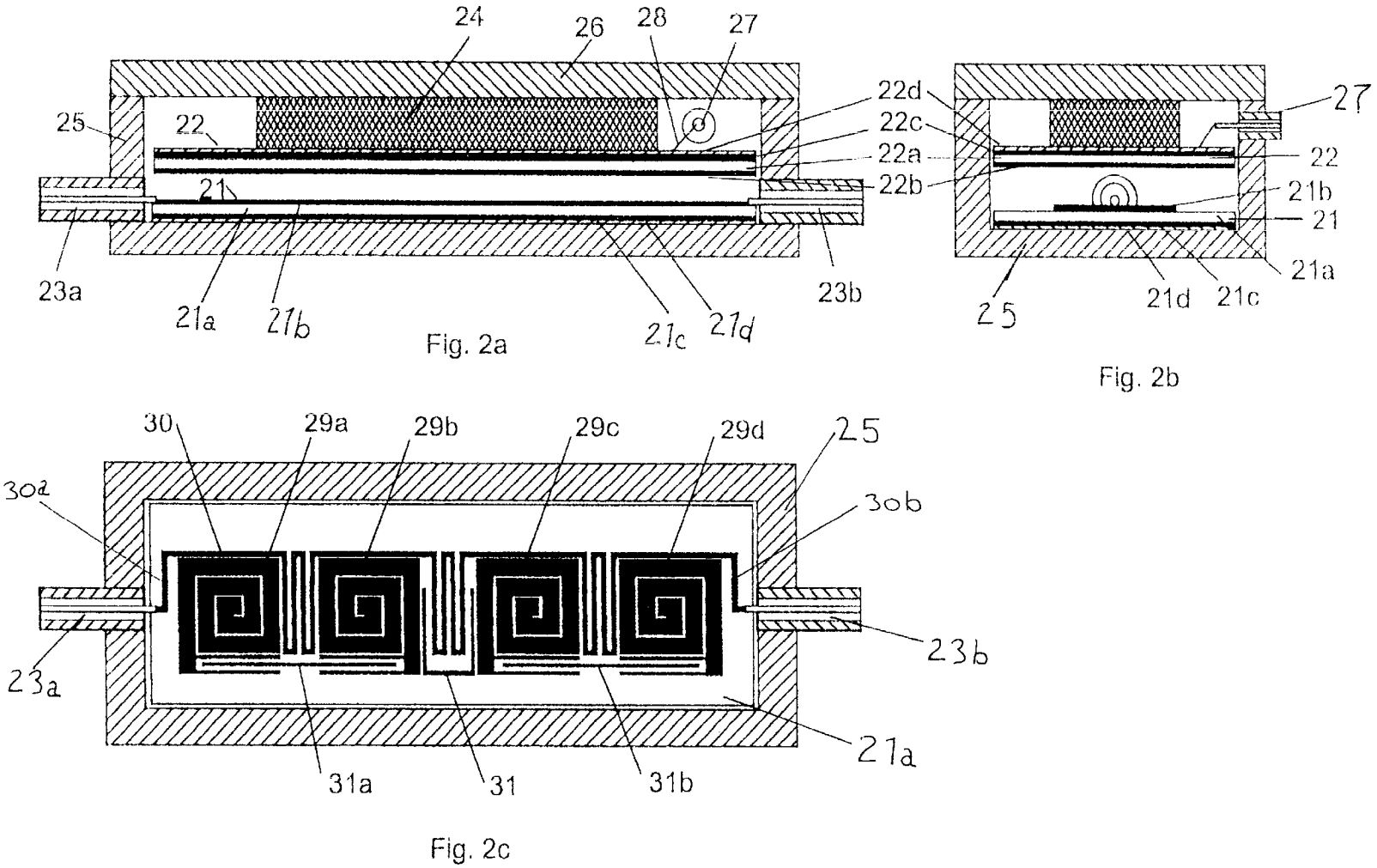
FIG. 2 shows various views of an illustrative embodiment of a tunable HTS band-reject filter in accordance with the present invention; specifically, an HTS 4-pole band-reject mini-filter circuit with square shaped spiral resonators.
FIG. 2*a* shows the longitudinal cross sectional view.
FIG. 2*b* shows the transverse cross-sectional view.
FIG. 2*c* shows the top view, in which the top of the enclosure, the plate and the actuator have been removed.

FIG. 2 shows an embodiment of the present invention of a tunable HTS band-reject filter. In FIG. 2*a*, 21 is the HTS filter circuit, and 22 is the plate. In FIG. 2*b*, 21*a* is the substrate of the HTS filter circuit 21. An HTS circuit pattern 21*b* is deposited on front surface of substrate 21*a*. A blank HTS film 21*c* is deposited on the back surface of substrate 21*a* serving as the ground plane of the filter 21. A conductive film 21*d* (preferably a metal such as gold or silver) is deposited on the surface of blank HTS film 21*c*.

The HTS circuit pattern 21*b* comprises four HTS spiral resonators, 29*a*, 29*b*, 29*c*, 29*d*, an HTS main transmission line 30, and inter-resonator coupling transmission lines, 31, 31*a*, 31*b*, to form a 4-pole HTS band-reject filter, as shown in FIG. 2*c*. The main transmission line 30 has an input coupling 30*a* connected to input connector 23*a*, an output coupling 30*b* connected to output connector 23*b*, and is in the zigzag form at the locations between the resonators. The purpose of such zigzag is for adjusting the phase to obtain maximum in-band rejection. The HTS filter circuit 21 is attached to the bottom (first inner surface) of enclosure 25. Input connector 23*a*, output connector 23*b*, and a tuning connector 27 are inserted into the side wall of enclosure 25. The input connector 23*a* and output connector 23*b* are connected to two ends of main transmission lines 30 to provide off-band signal pass through.

As shown in FIG. 2*b*, plate 22 comprises a substrate 22*a* with HTS films 22*b* and 22*c* deposited on the front side and back side of substrate 22*a*, respectively. A conductive film 22*d* (preferably a metal such as gold or silver) is deposited on top of HTS film 22*c*.

As shown in FIG. 2*a*, an actuator 24 made of piezoelectric material has one side attached to the back surface of plate 22 (via conductive film 22*d*) and the opposite side attached to the inner surface of a lid 26 (the second inner surface) constituting part of enclosure 5. Actuator 24 is used to move plate 4 relative to HTS filter circuit 21 for tuning the center frequency of the HTS filter circuit 21. A wire 28 with one end connected to a tuning connector 27 and the other end connected to actuator 24 via conductive film 22*d* is used to a apply tuning voltage to actuator 24.

In FIG. 1 and FIG. 2, the HTS resonators as the building blocks of the HTS filters are square-shaped spiral resonators, but they are not restricted in this particular form, and other resonator forms can also be used. FIG. 3 shows different embodiments of the HTS resonators that can be used as the building block of the tunable HTS filters.

FIG. 3*a* shows a rectangular shaped spiral single resonator made of an HTS transmission line curled up to form a spiral line with rounded corners. The rounded corner shown in FIG. 3*a* is in the 45° straight line form. Circular shape rounded corners can also be used.

FIG. 3*b* shows a rectangular shaped double spiral resonator made of two parallel HTS spiral lines joint at the center.

FIG. 3*c* shows a circular shaped single spiral resonator made of a transmission line curled to form a circular spiral.

FIG. 3*d* shows a mirror symmetrical rectangular shape spiral resonator made of a transmission line curled at two ends with mirror symmetry respect to the vertical center line.

FIG. 3*e* shows a 180° rotational symmetrical rectangular shaped spiral resonator made of a transmission line curled at two ends with 180° rotational symmetry respect to the center point.

FIG. 3*f* shows a double mirror symmetrical rectangular spiral resonator made of a vertical center transmission line split at two ends to form four spirals with mirror symmetry with respect to vertical and horizontal center lines.

FIG. 3*g* shows a 90° rotational symmetrical square shaped resonator made of four square shaped spirals having one end connected at the center and with 90° rotational symmetry with respect to the center point.

FIG. 3*h* shows a meander line resonator made of zigzag transmission line.

FIG. 3*i* shows a mirror symmetrical meander resonator made of two zigzag shape transmission lines with left ends joint and having mirror symmetry with respect to the horizontal center line.

FIG. 3*j* shows a double mirror symmetrical meander line resonator made of two mirror symmetrical meander resonator placed back to back to have mirror symmetry with respect to both vertical and horizontal center lines.

As indicated above, the resonator used in the present invention is not restricted to the embodiments shown in FIG. 3. In fact any planar resonator wherein the resonator pattern length along two directions is less than about 2% of wavelength can be used as the building block of the tunable HTS filters of the present invention. The small size is essential, because the space between HTS filter circuit 1 and plate 2 in FIG. 1, or HTS filter circuit 21 and plate 22 in FIG. 2, preferably should be kept uniform within the resonator area. Otherwise, the resonant frequency of each resonator could be different, which greatly complicates tuning of the filter and may cause performance deterioration.

As previously mentioned, using the movement of the plate to tune the center frequency of the HTS filter circuit may have a potential problem. The movement of the plate affects the magnetic field of the HTS filter circuit, which not only changes the frequency but also changes the inter-resonator coupling, which may cause performance deterioration.

One method to compensate for this problem is to carefully select the HTS film pattern on the front surface of the plate (opposite the HTS filter circuit) in order to only affect the frequency of the HTS resonators without affecting the inter-resonator coupling.

Figure 4:
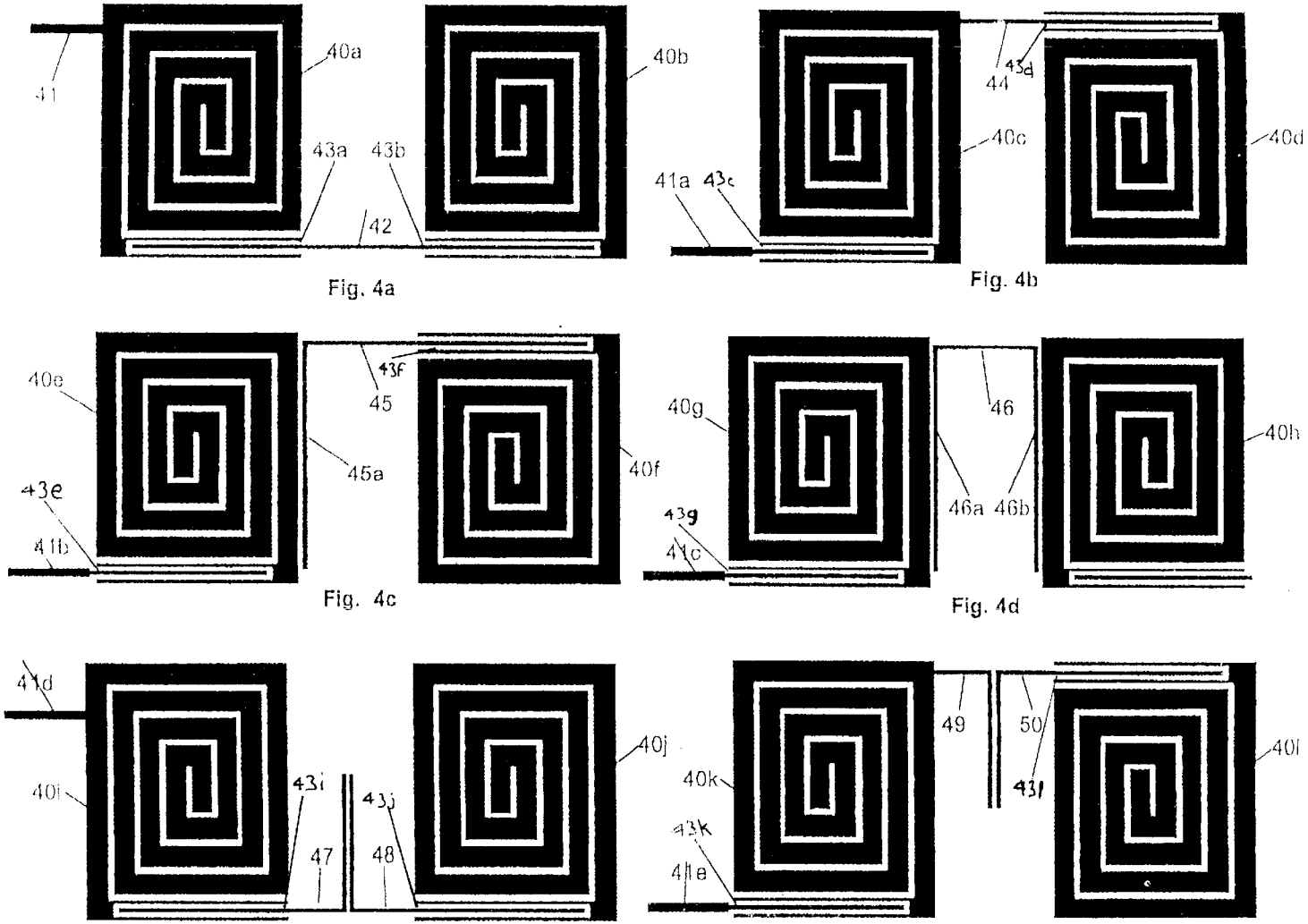
FIG. 4 shows various preferred embodiments of input coupling circuits and inter-resonator compensating coupling circuits suitable for use in the tunable HTS filters in accordance with the present invention.

Another method to compensate for this problem is to introduce compensating inter-resonator coupling circuit, which cancels out the unwanted inter-resonator coupling changes. Examples of suitable such inter-resonator coupling circuits are shown in FIG. 4.

FIG. 4*a* shows two adjacent spiral resonators 40*a* and 40*b* as part of a tunable HTS band-pass filter. An HTS transmission line 41 is coupled by direct attachment to resonator 40*a* as the input coupling circuit. A narrow HTS transmission line 42, with the left end inserted into a slot 43*a* at the end of resonator 40*a*, and the right end inserted into a slot 43*b* at the end of resonator 40*b*, provides the compensating coupling between resonators 40*a* and 40*b*.

FIG. 4*b* shows two adjacent spiral resonators 40*c* and 40*d* as part of a tunable HTS band-pass filter. An HTS transmission line 41*a* is coupled to resonator 40*c* with one end of transmission line 41*a* inserted into a slot 43*c* at the end of resonator 40*c* as the input coupling circuit. A narrow HTS transmission line 44, with the left end directly attach to resonator 40*c* and the right end inserted into a slot 43*d* at the end of resonator 40*d*, provides the compensating coupling between resonators 40*c* and 40*d*.

FIG. 4*c* shows two adjacent spiral resonators 40*e* and 40*f* as part of a tunable HTS band-pass filter. An HTS transmission line 41*b* is coupled to resonator 40*e* with one end of transmission line 41*b* inserted into a slot 43*e* at the end of resonator 40*e* as the input coupling circuit. A narrow HTS transmission line 45, with the left end 45*a* parallel to resonator 40*e* and the right end inserted into a slot 43*f* at the end of resonator 40*f*, provides the compensating coupling between resonators 40*e* and 40*f*.

FIG. 4*d* shows two adjacent spiral resonators 40*g* and 40*h* as part of a tunable HTS band-pass filter. An HTS transmission line 41*c* is coupled to resonator 40*g* with one end inserted into a slot 43*g* at the end of resonator 40*g* as the input coupling circuit. A narrow HTS transmission line 46, with the left end 46*a* parallel to resonator 40*g* and the right end 46*b* parallel to resonator 40*h*, provides the compensating coupling between resonators 40*c* and 40*d*.

FIG. 4*e* shows two adjacent spiral resonators 40*i* and 40*j* as part of a tunable HTS band-pass filter. An HTS transmission line 41*d* is coupled to resonator 40*i* with one end directly attached to resonator 40*i* as the input coupling circuit. The inter-resonator coupling is provided by two narrow HTS transmission lines 47 and 48. The left end of HTS transmission line 47 is inserted into a slot 43*i* at the end of resonator 40*i*, and the right end of HTS transmission line 48 is inserted into a slot 43*j* at the end of resonator 40*j*. The right end of HTS transmission line 47 and the left end of HTS transmission line 48 are parallel to each other.

FIG. 4*f* shows two adjacent spiral resonators 40*k* and 40*l* as part of a tunable HTS band-pass filter. An HTS transmission line 41*e* is coupled to resonator 40*k* with one end inserted into a slot 43*k* at the end of resonator 40*k* as the input coupling circuit. The inter-resonator coupling circuit comprises two narrow HTS transmission lines 49 and 50. The left end of HTS transmission line 49 is directly attached to resonator 40*k*. The right end of HTS transmission line 50 is inserted into a slot 43*l* at the end 40*l*. The right end of HTS transmission line 49 and the left end of HTS transmission line 50 are parallel to each other.

The inter-resonator coupling circuits of the tunable HTS filters in accordance with the present invention are not restricted to the specific forms shown in FIG. 4. In fact, any narrow transmission line with two ends capacitively coupled or directly attached to adjacent resonators can be used for such purpose.

FIG. 5 shows some examples of the HTS film patterns on the front surface of plates 2 and 22 in FIG. 1 and FIG. 2, respectively. FIG. 5*a* shows a blank HTS film 60 covering the entire front surface. FIG. 5*b* shows a blank HTS film 61 covering the substrate center part only and leaving the left part 62 and right part 62*a* uncovered, which is opposite where the input and output circuits lie on the HTS filter circuit. FIG. 5*c* shows four rectangular shaped areas opposite the four resonators in the HTS filter circuit. These four areas are covered with an HTS film 64*a* and leaving the rest of the surface 63 uncovered.

FIG. 6 shows another embodiment of a tunable HTS band-pass filter in accordance with the present invention, with different actuator arrangements for moving the plate. As shown in FIG. 6*a*, 71 is the HTS filter circuit, and 72 is the plate. As shown in FIG. 6*b*, 71*a* is the substrate of the HTS filter circuit 71. An HTS circuit pattern 71*b* is deposited on front side of substrate 71*a*. A blank HTS film 71*c* is deposited on back side of substrate 71*a* serving as the ground plane of the filter. A conductive film 71*d* (preferably a metal such as gold or silver) is deposited on the surface of blank HTS film 71*c*.

As shown in FIG. 6*c*, the HTS circuit pattern 71*c* comprises four HTS spiral resonators, 77*a*, 77*b*, 77*c*, 77*d*, input transmission line 80*a*, output transmission line 80*b*, and inter-resonator coupling transmission lines, 78, 78*a*, 78*b*, to form a 4-pole band-pass filter. The HTS filter circuit 71 is attached to the bottom (first inner surface) of enclosure 75. Input connector 73*a*, output connector 73*b*, and tuning connector 81 are inserted into the side wall of enclosure 75. The input connector 73*a* and output connector 73*b* are connected to the input and output transmission lines 80*a* and 80*b*, respectively.

As shown in FIG. 6*b*, the plate 72 comprises a substrate 72*a* with HTS film 72*b* deposited on the front surface of substrate 72*a* facing the HTS filter circuit 71. Four actuators 74*a*, 74*b*, 74*c*, 74*d*, made of piezoelectric material, have one side attach to plate 72 and the opposite side attached to the bottom (first inner surface) of enclosure 75. Actuators 74*a*, 74*b*, 74*c*, 74*d* are used to move the plate 72 relative to HTS filter circuit 71 for tuning the center frequency of HTS filter circuit 71. A wire 82 with one end connected to a tuning connector 81 and the other end connected to the four actuators 74*a*, 74*b*, 74*c*, 74*d* via a conductive film at the edges of HTS blank film 72*b* (not shown), is used to apply tuning voltage to the four actuators 74*a*, 74*b*, 74*c*, 74*d*.

While the present invention has been described in conjunction with specific embodiments thereof, it is evident that other alternatives, modifications, and variations will be apparent to those skilled in the art. Accordingly, it is intended to embrace all such alternatives, modifications and variations that fall within the spirit and broad scope of the appended claims.

What is claimed is:

1. A tunable HTS filter comprising:

(a) an enclosure having a first inner surface, a second inner surface spaced apart from and opposite to said first inner surface, and at least one other inner surface connecting said first and second inner surfaces to form said enclosure, wherein at least said inner surfaces of said enclosure are constructed of a conductive material, and wherein said enclosure is fitted with an input connector and an output connector;

(b) an HTS filter circuit within said enclosure, said HTS filter circuit comprising a substrate having a front surface spaced apart from and opposite to said second inner surface, a back surface in grounding contact with said first inner surface, an HTS filter element on said front surface, said HTS filter element comprising one or more HTS resonators, an input transmission line coupling said HTS filter element to said input connector, and an output transmission line coupling said HTS filter element to said output connector;

(c) a plate within said enclosure, said plate having a front surface spaced a distance apart from and opposite to said HTS filter circuit, and a back surface opposite to said second inner surface, wherein said front surface is covered with an HTS film on at least the portion of said front surface opposite said one or more resonators of said HTS filter element;

(d) an actuator connected to said plate and to one or more of said first inner surface, said second inner surface and said HTS filter circuit, said actuator defining said distance at which said front surface of said plate is spaced apart from said front surface of said HTS filter element, provided that said actuator connection is non-conductive between said plate and said HTS filter circuit; and (e) a tuning controller connected to said actuator to adjust said distance between said front surface of said plate and said HTS filter element of said HTS filter circuit.

2. The tunable HTS filter of claim 1, wherein the enclosure is a vacuum dewar assembly having a cryogenic source connected thereto.

3. The tunable HTS filter of claim 1, wherein the HTS filter circuit comprises:

(1) said substrate;

(2) at least two HTS resonators in intimate contact with said front surface of said substrate;

(3) an input transmission line with a first end coupled to a first one of said at least two HTS resonators, and a second end coupled to said input connector;

(4) an output transmission line with a first end coupled to a second of said at least two HTS resonators, and a second end coupled to said output connector;

(5) an inter-resonator coupling;

(6) a blank HTS film disposed on said back surface of said substrate; and (7) a film disposed on said blank HTS film as a grounding contact to said enclosure.

4. The tunable HTS filter of claim 3, wherein said inter-resonator coupling comprises an HTS transmission line at least in part disposed between an adjacent pair of said at least two HTS resonators such that said HTS transmission line couples said adjacent pair.

5. The tunable HTS filter of claim 4, wherein said HTS transmission line couples said adjacent pair of said at least two HTS resonators by direct attachment of said HTS transmission line to a said resonator, insertion of said HTS transmission line into a slot between two split branch lines at an end of a said resonator, placing said HTS transmission line close by and parallel to an edge of a said resonator, or any combination thereof.

6. The tunable HTS filter of claim 3, wherein said at least two HTS resonators comprise an HTS line oriented in a spiral fashion (i) such that adjacent lines are spaced from each other by a gap distance which is less than the line width; and (ii) so as to form a central opening within the spiral, the dimensions of which are approximately equal to the gap distance.

7. The tunable HTS filter of claim 3, which is an HTS band-pass filter.

8. The tunable HTS filter of claim 3, which is an HTS band-reject filter.

9. The tunable HTS filter of claim 1, wherein said actuator is a piezoelectric material.

10. The tunable HTS filter of claim 9, wherein said piezoelectric material operates at temperature below 80 K and has a sensitivity better than $5\times10^5$/volts/cm.

11. The tunable HTS filter of claim 1, wherein the HTS material is selected from one or more of $YBa_2Cu_3O_7$, $Tl_2Ba_2CaCu_2O_8$, $TlBa_2Ca_2Cu_3O_9$, $(TlPb)Sr_2CaCu_2O_7$ and $(TlPb)\ Sr_2Ca_2Cu_3O_9$.

12. The tunable HTS filter of claim 1, wherein the substrate material is selected from one or more of $LaAlO_3$, MgO, $LiNbO_3$, sapphire and quartz.

13. The tunable HTS filter of claim 1, which is an HTS band-pass filter.

14. The tunable HTS filter of claim 1, which is an HTS band-reject filter.

15. An HTS filter circuit comprising:

(1) a substrate having a front side and a back side;

(2) at least two HTS resonators in intimate contact with said front side of said substrate;

(3) an input coupling circuit comprising a transmission line with a first end coupled to a first one of said at least two HTS resonators, and a second end for coupling to an input connector;

(4) an output coupling circuit comprising a transmission line with a first end coupled to a second of said at least two HTS resonators, and a second end for coupling to an output connector;

(5) an inter-resonator coupling circuit comprising an HTS transmission line at least in part disposed between an adjacent pair of said at least two HTS resonators, said transmission line coupling said adjacent pair of HTS resonators;

(6) a blank HTS film disposed on said back side of said substrate; and (7) a film disposed on said blank HTS film as a grounding contact to an enclosure for said HTS filter circuit.

16. The HTS filter circuit of claim 15, wherein said HTS transmission line couples said adjacent pair of said at least two HTS resonators by direct attachment of said HTS transmission line to a said resonator, insertion of said HTS transmission line into a slot between two split branch lines at an end of a said resonator, placing said HTS transmission line close by and parallel to an edge of a said resonator, or any combination thereof.

17. The HTS filter circuit of claim 15, wherein said at least two HTS resonators comprise an HTS line oriented in a spiral fashion (i) such that adjacent lines are spaced from each other by a gap distance which is less than the line width; and (ii) so as to form a central opening within the spiral, the dimensions of which are approximately equal to the gap distance.

18. The HTS filter circuit of claim 15, wherein the HTS material is selected from one or more of $YBa_2CU_3O_7$, $Tl_2Ba_2CaCu_2O_8$, $TlBa_2Ca_2Cu_3O_9$, $(TlPb)Sr_2CaCu_2O_7$ and $(TlPb)\ Sr_2Ca_2Cu_3O_9$.

19. The HTS filter circuit of claim 15, wherein the substrate material is selected from one or more of $LaAlO_3$, MgO, $LiNbO_3$, sapphire and quartz.

* * * * *